US007107656B2

(12) United States Patent
Chu

(10) Patent No.: US 7,107,656 B2
(45) Date of Patent: Sep. 19, 2006

(54) SAFETY BUCKLE WITH TWO LOCKING POINTS

(76) Inventor: Young Chu, 744 Rancho Cir., Fullerton, CA (US) 92835

( * ) Notice: Subject to any disclaimer, the term of this patent is extended or adjusted under 35 U.S.C. 154(b) by 0 days.

(21) Appl. No.: 10/823,899

(22) Filed: Apr. 14, 2004

(65) Prior Publication Data

US 2005/0229364 A1 Oct. 20, 2005

(51) Int. Cl.
*A44B 11/00* (2006.01)

(52) U.S. Cl. ..... 24/198; 24/200

(58) Field of Classification Search ..... 24/163 R, 24/198, 200, 323, 570, 17 A; 2/323; 224/258, 224/600

See application file for complete search history.

(56) References Cited

U.S. PATENT DOCUMENTS 1,522,563 A * 1/1925 Weintraub ..... 24/198
1,972,933 A * 9/1934 Harrison ..... 24/200
2,407,466 A * 9/1946 Alberts ..... 24/200
3,064,271 A * 11/1962 Kuber ..... 24/200
3,104,436 A * 9/1963 Ostolaza ..... 24/198
3,192,587 A * 7/1965 White ..... 24/200
3,222,688 A * 12/1965 Rosenzweig ..... 24/200
4,262,406 A * 4/1981 Fredrickson et al. ..... 24/200
4,562,945 A * 1/1986 Erlandson ..... 224/150
5,245,731 A * 9/1993 Funathu ..... 24/200
5,297,514 A * 3/1994 Stout et al. ..... 119/863
5,848,454 A * 12/1998 Kojima ..... 24/200

* cited by examiner

*Primary Examiner*—Robert J. Sandy

(57) ABSTRACT

A safety buckle comprising a substantially flat elongated body comprising a first distal end opposite to a second distal end, the elongated body having a front surface and a back surface; and first, second and third slots, respectively formed in the elongated body, wherein the first, second and third slots are approximately parallel in direction to each other, so that a first blade is formed between the first and second slots, and a second blade is formed between the second and third slots, wherein the second and third slots are configured to receive a first end of a strap by way the first end being tied around the second blade, and wherein the first and second slots are configured to receive a second opposite end of the strap by way of the second end being wrapped around the first blade.

7 Claims, 1 Drawing Sheet

SAFETY BUCKLE WITH TWO LOCKING POINTS

BACKGROUND

1. Field of Invention

The invention relates to a safety buckle with two locking points at each end.

2. Related Art

Buckles for belts or straps have been around ever since people started using belt or straps to secure various items on their person. Items which use a belt and buckle combination included backpacks, safety harnesses, hip pockets, gurney straps, etc.

Typically, a buckle holds the belt or strap in place and is designed to create resistance so that the belt or strap does not come loose. Traditional belt or strap buckles are mostly flat in their designs. Accordingly, when a wearer's arms or hands brush against the edges of the buckle, the buckle can lift on either ends. Further, since traditional belt or strap buckles have a single locking point, when the arms or hands of the wearer brush against the belt or strap buckle, this movement can cause the locking point of the strap to become loose and the strap can unbuckle due to a single locking point.

As a result, the whole belt and buckle set up can come undone and in turn the belt or strap can easily come off of the wearer's body. Traditionally, to prevent this loosening of the belt, people have fed the belt or strap twice for a more secure tie-in. However, even this double feed method is susceptible to the belt or strap coming loose on occasions, when the wearer's hands or arms brush against the ends of the buckle.

Given the above, there is a need for a more secure buckle which will not loosen the belt or the strap even if the wearer lifts either ends of the buckle.

SUMMARY OF THE INVENTION

A safety buckle comprising a substantially flat elongated body comprising a first distal end opposite to a second distal end, the elongated body having a front surface and a back surface such that the first and second distal ends are bent backwards to form an approximately obtuse angle with the back surface.

First, second and third slots, respectively are formed in the elongated body, wherein the first, second and third slots are approximately parallel in direction to each other, so that a first blade is formed between the first and second slots, and a second blade is formed between the second and third slots.

The second and third slots are configured to receive a first end of a strap by way the first end being tied around the second blade. The first and second slots are configured to receive a second opposite end of the strap by way of the second end being wrapped around the first blade.

In one embodiment, the third slot is further configured to receive the second end of the strap after the second end is wrapped around the first blade. The second end of the strap is wrapped over top portion of the first and second slots before it is received by the third slot.

The first distal end acts as a locking point on the second end of the strap to apply pressure and limit movement of the strap within the first and second slots. The second end of the strap after being received by the third slot engages the second distal end. The second distal end acts as a locking point on the second end of the strap to apply pressure and limit movement of the strap within the third slot, for example.

These and other embodiments of the present invention will also become readily apparent to those skilled in the art from the following detailed description of the embodiments having reference to the attached figures, the invention not being limited to any particular embodiments disclosed.

BRIEF DESCRIPTION OF DRAWINGS

The accompanying drawings, which are included to provide a further understanding of the invention and are incorporated in and constitute a part of this specification, illustrate embodiments of the invention and together with the description serve to explain the principles of the invention.

Features, elements, and aspects of the invention that are referenced by the same numerals in different figures represent the same, equivalent, or similar features, elements, or aspects in accordance with one or more embodiments of the system.

DETAILED DESCRIPTION OF THE INVENTION

Figure 1:
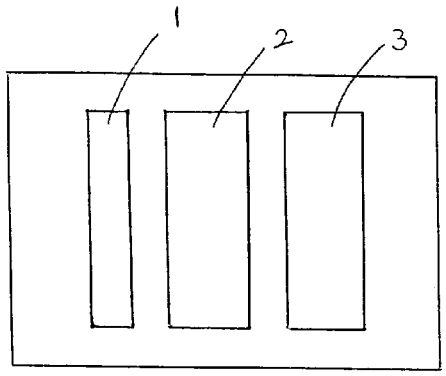
FIG. 1 is a top outer view of a safety buckle having three tie-in loops, in accordance with one embodiment of the invention.

Referring to FIG. 1, a safety buckle according to one embodiment of the invention comprises a flat elongated body having three slots (1, 2, 3) wherein a first slot (1) is configured to receive a belt (9), such as a flat woven rock-climbing strap, for example. The second and third slot (2, 3), respectively are configured to facilitate adjusting the belt (9).

The buckle body may be manufactured from steel, aluminum, hardened plastic or any other durable material suitable for the purposes of this invention. The slots (1, 2, 3) may be formed by a punching, molding, or machining process, or other suitable method. As shown in FIG. 1, the slots (1, 2, 3) are approximately rectangular in shape and a distance apart from each other, forming a first blade between the first and second slots (1, 2) and a second blade between the second and third slots (2, 3). In some embodiments, the first slot (1) has a smaller area in comparison with the second and third slots (2, 3).

Figure 2:
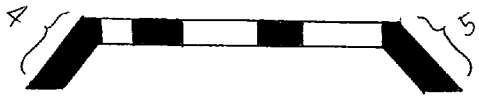
FIG. 2 is a side view of the safety buckle of FIG. 1, showing the distal opposite ends of the safety buckle bent in an angle inward, in accordance with one embodiment.

Referring to FIG. 2, in one embodiment, the buckle body has first and second opposing distal ends (4, 5), a top surface (illustrated in FIG. 1) and a bottom opposite surface (not shown). Each distal end (4, 5) respectively is bent toward the bottom surface. In some embodiments, the bottom surfaces of the bent distal ends (4, 5) form an obtuse angle with the bottom surface of the body of the buckle. In one embodiment this angles is approximately 125 degrees.

The angled distal ends (4, 5) can eliminate the loosening of the belt (9) by providing two locking points A and B at each distal end of the buckle. As such, the belt or strap (9), once fastened, will not come loose when either side of the buckle is lifted.

Figure 3:
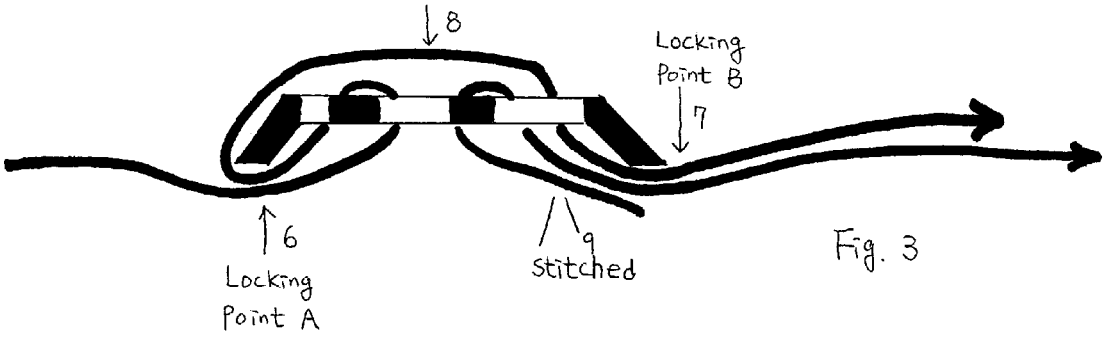
FIG. 3 illustrates the safety buckle of FIG. 2 in conjunction with a strap secured through the three tie-in loops, in accordance with one embodiment of the invention.

Referring to FIG. 3, the working mechanisms of the double locking point is illustrated. On one end, belt or strap (9) is secured (e.g., stitched) around the second blade formed in between the second (2) and third (3) slots, as shown, to firmly hold the buckle. On the opposite end, belt or strap (9)

is received by the second slot (2) from the bottom to exit the second (2) slot from the top. The belt or strap is then wrapped once around the first blade formed between the first (1) and second (2) slots, wherein the belt or the strap is received by the first slot (1) from the top to exit the bottom of the first slot (1).

To provide an added security, a back feed is applied, in one embodiment, wherein the opposite end of the belt or strap exiting the bottom of the first slot (1) is wrapped around the first distal end (4) and over first and second slots (1, 2) to enter the third slot (3) from the top and exit the third slot (3) from the bottom to pass under the second distal end (5).

Once looped into place, the belt or strap will be securely held into the buckle by two locking points A and B defined by the first and second distal ends respectively apply pressure to the strap (9). These locking points apply further pressure to the strap (9) and secure it in place when either of the distal ends (4, 5) is lifted.

If first distal end (4) is lifted, the downward angled second distal end (5) will result in application of added pressure on the belt so that it will not come loose on one side. Similarly, if second distal end (5) is lifted, the downward angled first distal end (4) will result in application of added pressure on the belt to prevent it from becoming loose on the other side.

The embodiments described above are to be considered in all aspects as illustrative only and not restrictive in any manner. Thus, other exemplary embodiments, architectures, designs, and implementations that can support various aspects of the invention may be utilized without departing from the essential characteristics described herein. These and various other adaptations and combinations of features of the embodiments disclosed are within the scope of the invention. The invention is defined by the claims and their full scope of equivalents.

What is claimed is:

1. A safety buckle comprising:

a substantially flat elongated body comprising a first distal end opposite to a second distal end, the elongated body having a front surface and a back surface such that the first and second distal ends are bent backwards to form an approximately obtuse angle with the back surface; and first, second and third slots, respectively formed in the elongated body, wherein the first, second and third slots are approximately parallel in direction to each other, so that a first blade is formed between the first and second slots, wherein the second and third slots are configured to receive a first end of a strap by way the first end being tied around the second blade;

wherein the first and second slots are configured to receive a second opposite end of the strap by way of the second end being wrapped around the first blade;

wherein the third slot is further configured to receive the second end of the strap after the second end is wrapped around the first blade; and wherein the second end of the strap is wrapped over a top portion of the first and second slots before it is received by the third slot.

2. The safety buckle of claim 1, wherein the first distal end acts as a locking point on the second end of the strap to apply pressure and limit movement of the strap within the first and second slots.

3. The safety buckle of claim 2, wherein the second end of the strap after being received by the third slot engages the second distal end.

4. The safety buckle of claim 3, wherein the second distal end acts as a locking point on the second end of the strap to apply pressure and limit movement of the strap within the third slot.

5. A safety buckle comprising:

a substantially flat elongated body comprising a first distal end opposite to a second distal end, the elongated body having a front surface and a back surface such that the first and second distal ends are bent backwards to form an approximately 125 degrees obtuse angle with the back surface; and first, second and third slots, respectively formed in the elongated body, wherein the first, second and third elongated slots are approximately parallel in direction to each other, so that a first blade is formed between the first and second slots, and a second blade is formed between the second and third slots;

wherein the second and third elongated slots are configured to receive a first end of a strap by way the first end being tied around the second blade, and wherein the first and second elongated slots are configured to receive a second opposite end of the strap by way of the second end being wrapped around the first blade; and wherein the third elongated slot is further configured to receive the second end of the strap after the second end of the strap is wrapped around the first blade, and wherein the second end of the strap is wrapped over a top portion of the first and second elongated slots before it is received by the third elongated slot.

6. The safety buckle of claim 5, wherein the first distal end acts as a locking point on the second end of the strap to apply pressure and limit movement of the strap within the first and second elongated slots, and wherein the second end of the strap after being received by the third elongated slot engages the second distal end.

7. The safety buckle of claim 6, wherein the second distal end acts as a locking point on the second end of the strap to apply pressure and limit movement of strap within the third elongated slot.

* * * * *